US006757919B2

(12) United States Patent
Snyder

(10) Patent No.: US 6,757,919 B2
(45) Date of Patent: Jul. 6, 2004

(54) AUTOMATICALLY OPERATED HANDLE-TYPE FLUSH VALVE

(75) Inventor: Jonathan W. Snyder, Wheaton, IL (US)

(73) Assignee: Sloan Valve Company, Franklin Park, IL (US)

( * ) Notice: Subject to any disclaimer, the term of this patent is extended or adjusted under 35 U.S.C. 154(b) by 0 days.

(21) Appl. No.: 10/228,690

(22) Filed: Aug. 27, 2002

(65) Prior Publication Data

US 2004/0040079 A1 Mar. 4, 2004

(51) Int. Cl.[7] ..... E03D 5/10
(52) U.S. Cl. ..... 4/406; 4/302; 4/DIG. 3
(58) Field of Search ..... 4/249, 302, 304, 4/305, 406, 623, DIG. 3; 251/129.03, 129.04, 40

(56) References Cited

U.S. PATENT DOCUMENTS 2,635,691 A * 4/1953 Filliung
3,778,023 A * 12/1973 Billeter
5,680,879 A * 10/1997 Sheih et al.

* cited by examiner

*Primary Examiner*—Tuan N. Nguyen
(74) *Attorney, Agent, or Firm*—Cook, Alex, McFarron, Manzo, Cummings & Mehler, Ltd.

(57) ABSTRACT

A flush valve includes a valve body having a valve for controlling flow between an inlet and outlet. A manual operator assembly includes a nut attached to the valve body. An adapter mounted in the nut has a plunger pin movable to initiate operation of the flush valve. A push member extends through an opening in the nut and has an end thereof in contact with the plunger pin. A sensor housing is attached to the nut and has a drive therewithin to cause movement of the push member against the plunger pin. A sensor connects a battery to the drive to initiate movement of the push member against the plunger pin.

14 Claims, 1 Drawing Sheet

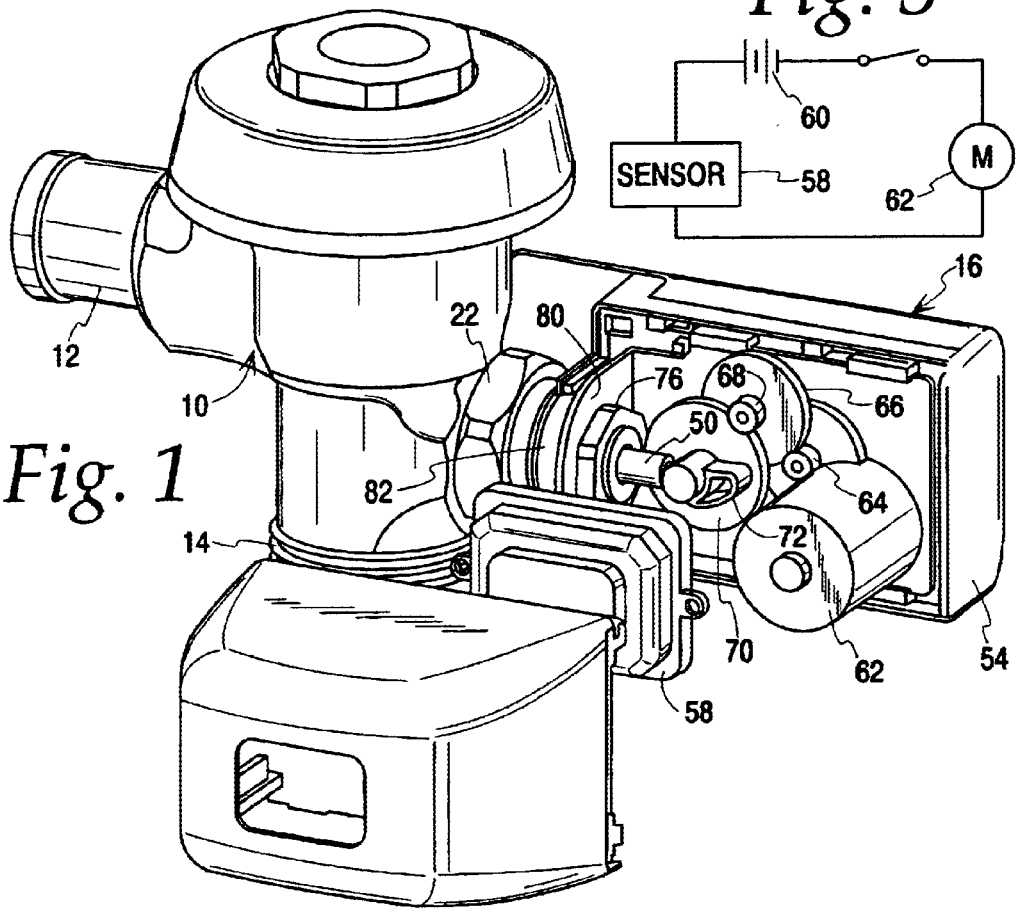
Fig. 1
Fig. 3
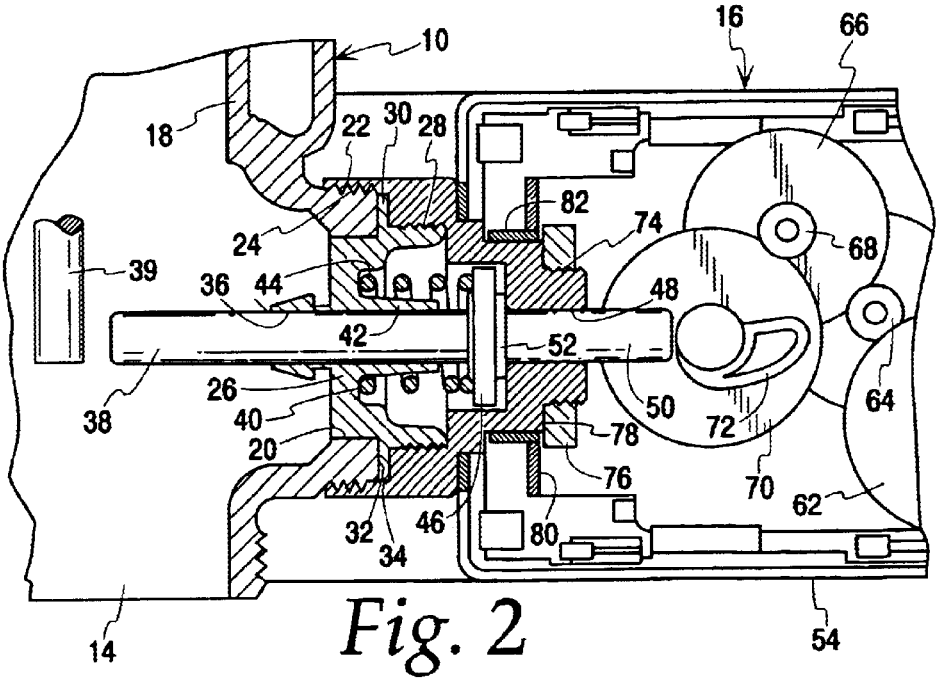
Fig. 2

AUTOMATICALLY OPERATED HANDLE-TYPE FLUSH VALVE

THE FIELD OF THE INVENTION

The present invention relates to flush valves of the type commonly used to operate toilets and urinals, and more specifically to an assembly which converts an existing valve from manual operation to automatic operation. The flush valve may be a diaphragm-type valve, such as that sold by Sloan Valve Company of Franklin Park, Ill., under the trademark "ROYAL," and which is shown, for example, in U.S. Pat. No. 6,216,730, or it may be a piston-type flush valve sold by Sloan Valve Company under the trademarks "GEM" and "CROWN" and shown, for example, in U.S. Pat. No. 5,881,993.

The present invention is more specifically directed to a retrofit kit or assembly for a handle-operated flush valve in which the manual handle may be replaced by a pushbutton operator which in turn is actuated by a sensor-initiated drive motor. Such a retrofit assembly may be attached to the flush valve, after removing the handle, without disconnecting the water supply to the flush valve. All of the above types of flush valve have a handle which is mounted on the flush valve body for pivotal movement about a handle axis. Sloan Valve Company has in the past sold a pushbutton operator which replaces the manual handle for manual operation of the flush valve, but utilizing a pushbutton instead of a pivotal handle. The retrofit assembly of the present invention replaces the pivotal handle with a pushbutton assembly, with the pushbutton assembly being a part of a sensor-operated drive for actuating the flush valve.

The retrofit assembly includes the pushbutton assembly described and a housing which will be attached thereto and within which is mounted a drive for moving the pushbutton, a sensor and a battery, with the sensor connecting the battery to the drive for movement of the pushbutton, which in turn operates the flush valve. This provides conversion of a manually-operated flush valve to automatic operation.

Of particular advantage in the invention is the fact that conversion from manual operation to automatic operation can be completed, merely by removing the manual handle and mounting the pushbutton assembly and sensor housing thereto, all without disconnecting the water supply to the flush valve.

SUMMARY OF THE INVENTION

The present invention relates to toilet flush valves and more specifically to an assembly for converting a valve of this type from manual operation to automatic operation.

A primary purpose of the invention is to provide a conversion assembly as described which may be installed without disconnecting the water supply to the flush valve.

Another purpose of the invention is to provide a conversion assembly of the type described which mounts on the flush valve body, utilizes a pushbutton assembly in place of the conventional pivotal flush valve handle, and adds a sensor operated drive for moving the pushbutton.

Another purpose is to provide a conversion assembly as described which is suitable for right or left hand operation.

Other purposes will appear in the ensuing specification, drawings and claims.

BRIEF DESCRIPTION OF THE DRAWINGS

The invention is illustrated diagrammatically in the following drawings wherein:

FIG. 1 is a front perspective view of the flush valve assembly of the present invention with portions being in exploded form;

FIG. 2 is an enlarged section through the mounting of the housing to the flush valve body; and FIG. 3 is a wiring diagram.

DESCRIPTION OF THE PREFERRED EMBODIMENT

The present invention relates to a conversion assembly for manually-operated toilet room flush valves which may be of the diaphragm type or of the piston type. A diaphragm-type flush valve is shown in U.S. Pat. No. 6,216,730, the disclosure of which is herein incorporated by reference, and is sold by Sloan Valve Company, the assignee of the present application, under the trademark "ROYAL." The piston-type flush valve may be of the type shown in U.S. Pat. No. 5,881,993, the disclosure of which is herein incorporated by reference and may be sold by Sloan Valve Company under the trademarks "GEM" or "CROWN."

The conversion assembly may utilize a sensor, which may be of the infrared type, and will be battery powered and may be as shown in U.S. Pat. No. 6,056,261, also owned by Sloan Valve Company, and the disclosure of which is hereby incorporated by reference. Sensor-operated, battery-powered flush valves are known in the art from the '261 patent and others. The present invention utilizes the technology in the '261 patent or similar technologies for infrared operation of a flush valve which may be of the types described in the above-referenced patents. The particular disclosure shown herein illustrates a valve of the "ROYAL" type, as it includes a diaphragm-operated valve assembly.

In the drawings, a flush valve is indicated generally at 10 and will have an inlet connection 12, and an outlet connection 14. In the "ROYAL" valve, as in the piston-operated valve of the "GEM" or "CROWN" types, there is a valve member which normally closes the water flow path between the inlet and the outlet. In the "ROYAL" type flush valve, this valve member is a diaphragm, whereas, in the "GEM" or "CROWN" valves, this member is a piston-operated valve assembly. In either case, there is what is known as a relief valve, shown in the above-identified patents, which extends down from the valve member and which will be tripped by the operation of the pivotally mounted manual handle on the side of the valve. The present invention removes the manual pivotally-operated handle and replaces it with a valve-operated assembly which makes the flush valve automatic. The conversion assembly which translates a manual valve with a pivotally-operated handle into an automatic valve is shown generally at 16 in FIG. 1.

Focusing on FIG. 2, the flush valve 10 has a flush valve body 18 which has a valve body opening 20 to which is normally attached the pivotally-operated handle. In the present instance, this handle is removed, without affecting any of the water connections to the flush valve, and the handle is replaced with the assembly 16.

The assembly 16 may be thought of as containing two components or sub-assemblies. The first is a pushbutton assembly, long sold by Sloan Valve Company as an alternative to the pivotally-operated handle. This pushbutton assembly is attached by a nut to the valve body opening 20. As shown herein, this pushbutton assembly consists of a nut 22 which has an interior thread 24 for use in attaching the assembly to the threaded end of the valve opening 20. Positioned within the nut 22 is a bushing 26 which is threaded to the nut, as at 28. Both the described threaded connections are interior, with the threaded connection 28 having a diameter slightly less than that of the connection 24. The bushing 26 may have a flange 30 which is held between a shoulder 32 on the valve body adjacent the opening 20 and a shoulder 34 on the nut 22.

The bushing has a central bore 36 within which is positioned a plunger pin 38, with the interior end of the plunger pin, when the assembly is attached to a flush valve, being positioned to trip the relief valve 39 of either a "ROYAL" type or "GEM" or "CROWN" type flush valve.

A spring 40 encircles a portion 42 of the bushing and has one end bottomed in a recess 44 of the adapter, with the other end bearing against a head 46 of the plunger pin 38. Thus, the spring 40 will normally urge the plunger pin to an outward position, as illustrated in FIG. 2.

The nut 22 has a bore 48 within which is positioned a push element or push member or pushbutton 50. The button 50 has a head portion 52 which is in contact with the head 46 of the plunger pin and when the pushbutton 50 is moved in an inward direction, to the left as shown in the drawings, it will move the plunger pin against the force of spring 40 into a position to trip the relief valve.

Attached to the above-described pushbutton assembly is an electrical operator which includes a housing 54 within which is positioned an infrared sensor unit 58 connected to a battery 60 and to a drive motor 62. The drive motor, shown in FIG. 1 within the housing 54, when activated, will drive a first gear 64, which in turn drives a second gear 66. The small gear 68 on gear 66 will drive a cam member 70 having an outwardly-extending cam element 72. The cam element 72 is positioned to contact the end of pushbutton 50 which will in turn cause the above-described movement of the pushbutton, plunger pin, and ultimately the relief valve, of the flush valve.

The housing 54 is attached to the nut 22 by means of a threaded connection between a thread 74 on the end of the nut 22, which thread is exterior and has the smallest diameter of the three threaded areas on the nut. A nut 76 will be tightened down against a shoulder of the nut indicated at 78. There is a bracket 80 which is a part of the housing 54 which is used to actually attach the housing to the nut. Pressed into the bracket 80 is a sleeve bushing 82. The sleeve bushing 82 will permit a degree of relative rotation between the housing 54 and the nut 22 which attaches the assembly to the flush valve body. In effect, the nut 22 is free to rotate within the bushing 82 so that the nut 22 may be rotated when attaching the entire assembly to the flush valve body.

In assembling the described conversion kit it may be done in two steps or in one. If done in one step, the housing 54 and the described internal components will be attached to the nut 22 at the factory. The nut is free to rotate relative to the housing so that the entire assembly may be attached to the flush valve body. In the alternative, the nut 22 and its pushbutton sub-assembly may be attached first to the flush valve body, after which the housing 54 and its internal components may be attached to the nut. It is preferred that the conversion kit be assembled at the factory.

In operation, when the sensor detects the presence of a user of the flush valve, as is illustrated in the above-referenced patents, it will connect the battery 60 to the motor 62. The motor 62 through the described gears will rotate the cam member 70, which in turn will cause the cam 72 to contact and move the pushbutton 50. This moves the plunger pin inwardly into the flush valve body to trip the relief valve and flush valve operation will proceed from there.

Of particular importance is the fact that the conversion kit can be installed without opening the valve water chamber. It is only necessary to remove the pivotal handle and then attach the conversion assembly as described.

Whereas the preferred form of the invention has been shown and described herein, it should be realized that there may be many modifications, substitutions and alterations thereto.

What is claimed is:

1. A toilet room flush valve for use in flushing toilets and urinals includes a valve body having a water inlet and a water outlet, valve means within the body for controlling flow between the inlet and outlet, a manual operator opening in the body for use in mounting a manual operator assembly to operate the valve means, the manual operator assembly including a nut threadably attached to the valve body at the manual operator opening, an adapter positioned within the nut and attached thereto, a plunger pin movable within the adapter and having an interior end positioned to contact and initiate movement of the valve means, a spring on the adapter and urging the plunger pin outwardly of the manual operator opening, a push member extending through an opening in the nut and having a first end thereof in contact with the plunger pin, a sensor assembly for causing sensor initiated movement of the push member including a housing mounted on the nut such that the nut and the housing are rotatable relative to one another when said nut and housing are pre-assembled so as to allowed the nut of said nut and housing combination to threadably mount to the valve body without rotating the housing, a second end of the push member extending into the housing, drive means within the housing for moving the push member against the plunger pin to initiate operation of the valve means, a battery for operating the drive means, and a sensor mounted within the housing and connected to the drive means and battery to cause the application of battery power to the drive means.

2. The toilet room flush valve of claim 1 wherein the nut has three separate and independent threaded areas, a first threaded area to attach the nut to the valve body at the manual operator opening, a second threaded area to connect the adapter to the nut, and a third threaded area to attach the housing to the nut.

3. The toilet room flush valve of claim 2 wherein the threaded areas are coaxial, with the third threaded area being on an exterior surface of the nut, and the first and second threaded areas being on interior surfaces of the nut.

4. The toilet room flush valve of claim 2 wherein each of said threaded areas are coaxial, with the diameter of the first threaded area being greater than the diameter of the second threaded area which is greater than the diameter of the third threaded area.

5. The toilet room flush valve of claim 2 wherein said adapter has an outwardly-extending flange positioned between a shoulder on the nut and a portion of the valve body adjacent the manual operator opening.

6. The toilet room flush valve of claim 1 including a bushing sleeve positioned between the nut and a portion of the housing.

7. The toilet room flush valve of claim 1 wherein said drive means includes a drive motor and a cam member driven by said drive motor and having a cam thereon positioned to contact the second end of said push member to cause movement thereof against said plunger pin.

8. A retrofit assembly for conversion of a manual operated flush valve to automatic operation and in which the flush valve includes a valve body having a water inlet and a water outlet, valve means within the body for controlling flow between the inlet and outlet, and a manual operator opening for use in mounting a manual operator to operate the valve means, the assembly including:

a nut for threaded attachment to the valve body at the manual operator opening, an adapter positioned within the nut and attached thereto, a plunger pin movable within the adapter and having an interior end positioned to contact and initiate movement of the valve means, a spring on the adapter and urging the plunger pin outwardly of the manual operator opening, a push member extending through an opening in the nut and having a first end thereof in contact with said plunger pin, a sensor assembly for causing sensor initiated movement of the push member including a housing mounted on the nut such that the nut and the housing are rotatable relative to one another when said nut and housing are pre-assembled so as to allowed the nut of said nut and housing combination to threadably mount to the valve body without rotating the housing.

9. The retrofit assembly of claim 8 wherein the nut has three separate and independent threaded areas, a first threaded area to attach the nut to the valve body at the manual operator opening, a second threaded area to connect the adapter to the nut, and a third threaded area to attach the housing to the nut.

10. The retrofit assembly of claim 9 wherein the threaded areas are coaxial, with the third threaded area being on an exterior surface of the nut, and the first and second threaded areas being on interior surfaces of the nut.

11. The retrofit assembly of claim 9 wherein each of said threaded areas are coaxial, with the diameter of the first threaded area being greater than the diameter of the second threaded area which is greater than the diameter of the third threaded area.

12. The retrofit assembly of claim 9 wherein said adapter has an outwardly-extending flange positioned between a shoulder on the nut and a portion of the valve body adjacent the manual operator opening.

13. The retrofit assembly of claim 8 including a bushing sleeve positioned between the nut and a portion of the housing.

14. The retrofit assembly of claim 8 wherein said drive means includes a drive motor and a cam member driven by said drive motor and having a cam thereon positioned to contact the second end of said push member to cause movement thereof against said plunger pin.

* * * * *